US007871140B2

(12) United States Patent
Ohama et al.

(10) Patent No.: US 7,871,140 B2
(45) Date of Patent: Jan. 18, 2011

(54) IMAGE RECORDING APPARATUS

(75) Inventors: Takashi Ohama, Iwakura (JP); Kazuhito Ishida, Ichinomiya (JP); Yukichi Sawaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 209 days.

(21) Appl. No.: 11/071,533

(22) Filed: Mar. 4, 2005

(65) Prior Publication Data

US 2005/0206667 A1 Sep. 22, 2005

(30) Foreign Application Priority Data

Mar. 5, 2004 (JP) ..... P2004-063201

(51) Int. Cl.
*B41J 29/38* (2006.01)

(52) U.S. Cl. ..... 347/3; 347/2; 347/5

(58) Field of Classification Search ..... 347/16, 347/22, 9, 50–51, 108, 2–5, 115
See application file for complete search history.

(56) References Cited

U.S. PATENT DOCUMENTS 4,924,320 A * 5/1990 Tanaka et al. ..... 358/296
5,179,392 A * 1/1993 Kawaguchi ..... 347/118
5,822,081 A * 10/1998 Hatano et al. ..... 358/400
5,876,129 A 3/1999 Suzuki
5,971,519 A * 10/1999 Horikoshi ..... 347/16
6,168,327 B1 1/2001 Tsuzuki
6,318,853 B1 11/2001 Asano et al.
6,483,529 B1 11/2002 Ito et al.
6,634,746 B2 * 10/2003 Kawakami ..... 347/108
6,802,601 B2 10/2004 Suzuki et al.
6,856,338 B2 * 2/2005 Takahashi et al. ..... 347/225
7,052,106 B1 * 5/2006 Onuma et al. ..... 347/22
2002/0061219 A1 5/2002 Suzuki
2002/0117796 A1 8/2002 Miyamoto
2003/0052956 A1 3/2003 Katsuyama
2003/0063908 A1 4/2003 Silverbrook
2003/0085869 A1 5/2003 Lapstun et al.
2003/0184622 A1 10/2003 Sasaki et al.

(Continued)

FOREIGN PATENT DOCUMENTS

CN 1268436 A 10/2000

(Continued)

OTHER PUBLICATIONS esp@cenet Family list view for JP 2003-289408, search date Nov. 26, 2004.

(Continued)

*Primary Examiner*—Lam S Nguyen
(74) *Attorney, Agent, or Firm*—Banner & Witcoff, Ltd.

(57) ABSTRACT

An image recording apparatus includes an image recording unit that records an image on a recording medium; a supply unit that supplies a recording medium to the image recording unit; a discharging unit that discharges the recording medium having the image recorded thereon to an outside of the image recording apparatus; and a control unit having a circuit board that controls a driving of the image recording unit. The control unit is in alignment with the image recording unit at at least one of an upper side of the supply unit and the discharge unit within a height of the located image recording unit.

24 Claims, 12 Drawing Sheets

U.S. PATENT DOCUMENTS

| | | | |
|---|---|---|---|
| 2003/0184623 | A1 | 10/2003 | Sasaki et al. |
| 2003/0184626 | A1 | 10/2003 | Sasaki et al. |
| 2003/0184627 | A1 | 10/2003 | Sasaki et al. |
| 2003/0184771 | A1 | 10/2003 | Yamamoto et al. |
| 2004/0150697 | A1 | 8/2004 | Sasaki et al. |
| 2004/0160497 | A1 | 8/2004 | Suzukui et al. |
| 2004/0212655 | A1 | 10/2004 | Sasa |

FOREIGN PATENT DOCUMENTS

| | | | |
|---|---|---|---|
| CN | 1406181 | A | 3/2003 |
| EP | 0 899 103 | A2 | 3/1999 |
| EP | 1258366 | | 11/2002 |
| EP | 1348558 | | 10/2003 |
| JP | 05-030168 | | 2/1993 |
| JP | 10-268988 | | 10/1998 |
| JP | 2003-143341 | | 5/2003 |
| JP | 2002-289406 | | 10/2003 |
| JP | 2003289406 | | 10/2003 |
| JP | 2004025588 | A | 1/2004 |
| WO | WO 03/068509 | | 8/2003 |

OTHER PUBLICATIONS

Office Action in Chinese Patent Application No. 200510053149.7 dated Aug. 18, 2006.

Chinese Office Action dated Jan. 18, 2008 for Application No. 200510053149.7 and English translation thereof.

Office Action issued Sep. 8, 2009 in corresponding Japanese Patent Application No. 2004-063201, and partial translation thereof.

Office Action issued Sep. 8, 2009 in corresponding Japanese Patent Application No. 2004-063201, and partial translation thereof.

Noticfication of Reasons for Refusal in corresponding Japanese Patent Application 2009-253782 mailed Sep. 14, 2010.

US 6,698,873, 03/2004, Sasaki (withdrawn)

* cited by examiner

IMAGE RECORDING APPARATUS

BACKGROUND OF THE INVENTION

1. Field of the Invention

The present invention relates to an image recording apparatus.

2. Description of the Related Art

An image recording apparatus having a printer function of recording information on a recording medium such as paper or the like has been hitherto known (JP-A-2003-289406).

This image recording apparatus mainly comprises a printer engine for printing information on a recording sheet to form an image, a power supply board and a main board for controlling the engine. The main board is disposed along the front-and-rear direction of the image recording apparatus, and the printer engine is disposed along the right-and-left direction of the image recording apparatus. Therefore, the main board and the printer engine are arranged so as to cross each other in plan view.

SUMMARY OF THE INVENTION

According to the above structure, the main board and the printer engine cross each other, and thus they are required to be arranged so as to be positionally displaced from each other in the height direction. Accordingly, the device must be designed to be bulky, and thus it is impossible to sufficiently satisfy a requirement of lowering the profile of the device.

The present invention has been implemented in view of the foregoing situation.

It is an object of the present invention to provide an image recording apparatus which can be designed in compact size.

According to one aspect of the invention, there is provided with an image recording apparatus including: an image recording unit that records an image on a recording medium; a supply unit that supplies a recording medium to the image recording unit; a discharging unit that discharges the recording medium having the image recorded thereon to an outside of the image recording apparatus; and a control unit having a circuit board that controls a driving of the image recording unit. The control unit is located at at least one of an upper side of the supply unit and the discharge unit. The control unit is within a height of the image recording unit. The control unit is disposed in alignment with the image recording unit.

By thus configuration, the control unit is located substantially within the height range of the image recording unit, and thus this construction is suitable to reduce the height of the image recording apparatus.

According to another aspect of the invention, the supply unit and the discharge unit are disposed to be stacked in an up-and-down direction of the image recording apparatus.

By thus configuration, the supply unit and the discharge unit are arranged to be stacked in the vertical direction, so that the height of the device can be further reduced.

According to another aspect of the invention, the image recording unit further includes a recording head which is reciprocated in a direction intersecting to a feeding direction of the recording medium. The control unit is designed in a laterally-elongated and substantially rectangular shape so as to extend along the reciprocating direction of the recording head.

By thus configuration, the control unit is designed to be matched with the direction of the reciprocating motion of the recording head, and thus the device can be also miniaturized in the depth direction or width direction.

According to another aspect of the invention, a power supply unit is disposed at a lower side of the control unit so as to be located at at least one of a side of the discharge unit and a side of the supply unit.

By thus configuration, an empty space can be formed at the side of the discharge unit or supply unit, and the power supply unit is disposed in this space. As described above, the empty space is effectively used to thereby miniaturize the device. Furthermore, the power supply unit is located just below the control unit, and thus the connection cable may be short.

According to another aspect of the invention, the image recording apparatus further includes: a network board that carries out a line-fixed communication through a communication line. The network board is connected to the communication line through a wire so as to be adjacent to the power supply unit The network board and the power supply unit are mounted on a fixing member to be assembled as a unit.

By thus configuration, the network board and the power supply unit are assembled as a unit, and thus they are easily treated. Specifically, assembly, deassembly and specification development (100V or 200V) can be easily performed.

According to another aspect of the invention, outer peripheries of the network board and the power supply unit are covered by a coating member.

By thus configuration, even when ignition occurs due to electric leakage or the like, the coating member has a function of preventing spreading of ignition.

According to another aspect of the invention, the control unit has a connector connectable to a recording medium.

According to another aspect of the invention, the image recording apparatus further includes: a housing accomodatable the image recording unit and the control unit therein, wherein the control unit is mounted in the housing so that the connector faces the front surface of the housing. The housing is provided with at least one insertion port intercommunicating with the connector.

By thus configuration, the connector is directly secured to the control unit, and thus no harness is required. Therefore, the cost can be reduced, the assembly performance can be enhanced, and the quality can be stabilized. Furthermore, the insert port is formed in the front surface of the housing, and thus the recording medium can be easily secured.

According to another aspect of the invention, the image recording apparatus further includes: a reception-side connector which is provided above the control unit and electrically connects to other electronic equipment. The housing is provided with a cable wiring groove having one end side intercommunicating with the reception-side connector and the other side intercommunicating with a cable outlet opened to any side surface of the housing.

When the control unit is disposed at the front surface of the housing, the cable for electrically connecting the electric equipment such as a personal computer or the like and the control unit is wired through the receiving connector in the housing. In this case, when the cable has play in the housing, the cable may be pinched and thus damaged by the lid and the housing at the opening/closing time. By thus configuration, the cable is wired along the cable wiring groove, and thus such a situation can be avoided in advance.

According to another aspect of the invention, there is provided with an image recording apparatus including: a housing accomodatable an image recording unit that records an image on a recording medium; and a control unit that includes a circuit board for controlling the image recording unit, wherein the control unit is disposed at one corner portion of the housing. A communication unit having an antenna for reception/transmission is disposed at the other corner portion opposing to the corner portion concerned.

When the miniaturization of the device is developed, various electrical parts, etc. are arranged in close proximity to one another. If the control unit and the communication unit are arranged in proximity to each other, the circuit board is liable to suffer noises, and thus there is a risk that the circuit board does not normally function. By thus configuration, the communication unit and the control unit are arranged at the opposing corners of the housing to be away from each other, so that this invention effectively performs a normal communication function as a noise countermeasure.

According to another aspect of the invention, the control unit is configured by the circuit board. The circuit board is surrounded by a metal shield member.

The circuit board is shielded and thus it can be shielded from electrical radiation noises.

According to another aspect of the invention, the shield member is divisibly configured by a pair of shield cases for accommodating a circuit board between the confronting faces thereof.

By thus configuration, the shield member is divisibly constructed, and thus it is easy to disassembly mount the shield member. In addition, there can be used a method of using only one shield case in order to avoid the interference with peripheral parts under some specification.

According to another aspect of the invention, an image reading unit readable image in formation of an original is mounted on an upper surface of the housing while one side edge portion of the upper surface of the housing serves as a hinge. An operation unit having a circuit board for inputting an operation signal is appended to the image reading unit. The control unit is disposed to be adjacent to a side wall of the housing at which the hinge is provided. The hinge portion serves as a wiring path of a cable for connecting the control unit and the operation unit to each other.

By thus configuration, the hinge portion serves as a cable wiring path, and excessive tensility is hardly applied to the cable in connection with the opening/closing operation (the rotating operation around the hinge) of the reading unit. Furthermore, the control unit is disposed to be adjacent to the hinge, and thus the cable wiring path can be designed to have the shortest length.

DETAILED DESCRIPTION OF THE PREFFERD EMBODIMENTS

An embodiment of the present invention will be described with reference to FIGS. 1 to 12.

Figure 1:
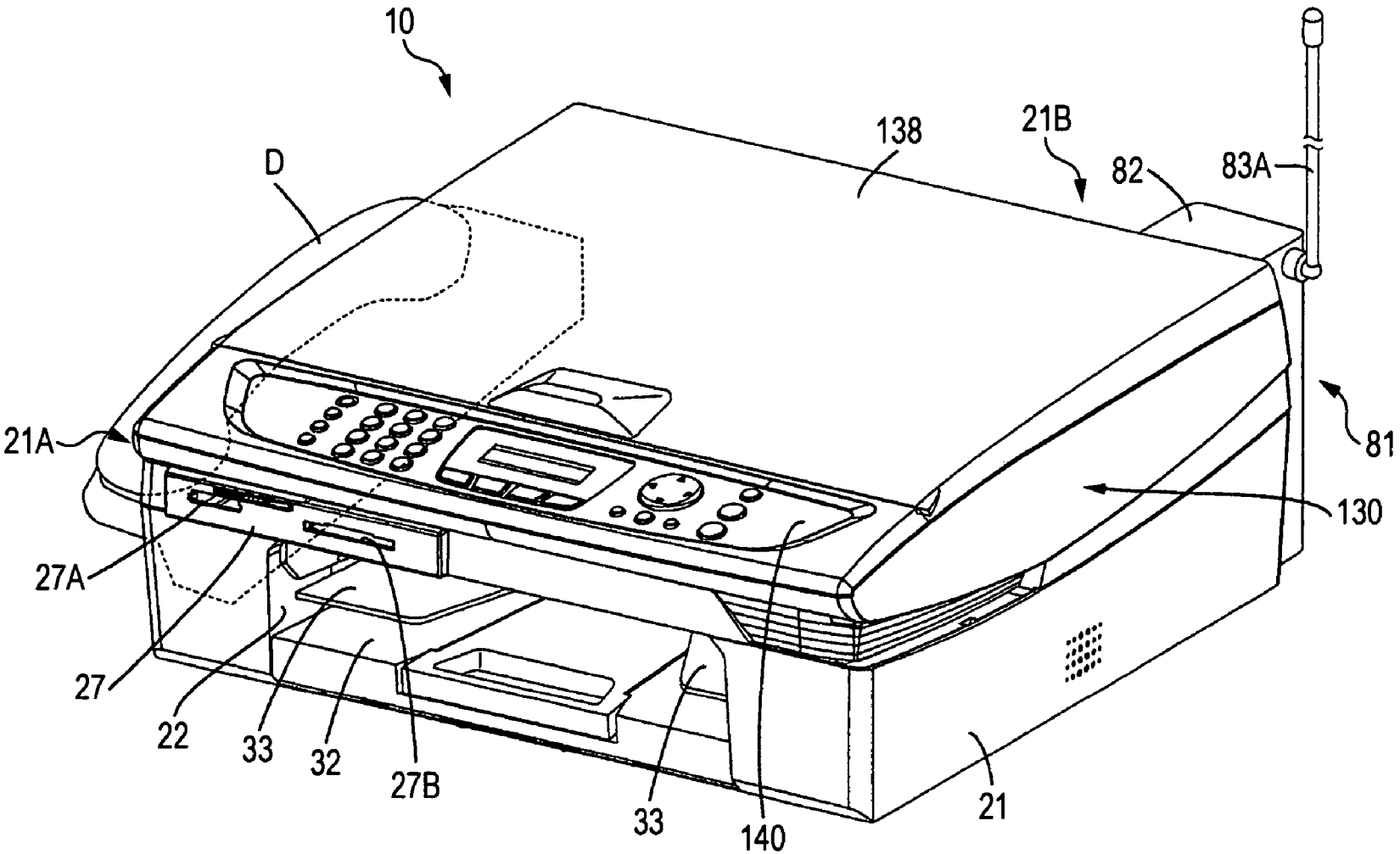
FIG. 1 is a perspective view showing a composite machine according to an embodiment of the present invention.

FIG. 1 is a perspective view showing a composite machine applied to this embodiment (corresponding to an image recording apparatus of the embodiment of the invention). The composite machine 10 has a communication function in addition to a facsimile function, and further has a scanner function and a printer function when connected to a personal computer or the like. In the following description, the near side of FIG. 1 is set as a front side, and the right-and-left direction is defined on the basis of the orientation of FIG. 1.

The composite machine 10 has a flat bed type scanner device (corresponding to an image reading unit of the embodiment of the present invention) 130 disposed at the upper side of a case body (corresponding to a housing of the embodiment of the present invention) 21 in which various devices included in a printer are accommodated. Operating keys and a touch panel are provided at the front side of the scanner device 130, and also an operation panel 140 for carrying out an input operation of a telephone number, etc. is also disposed.

Figure 2:
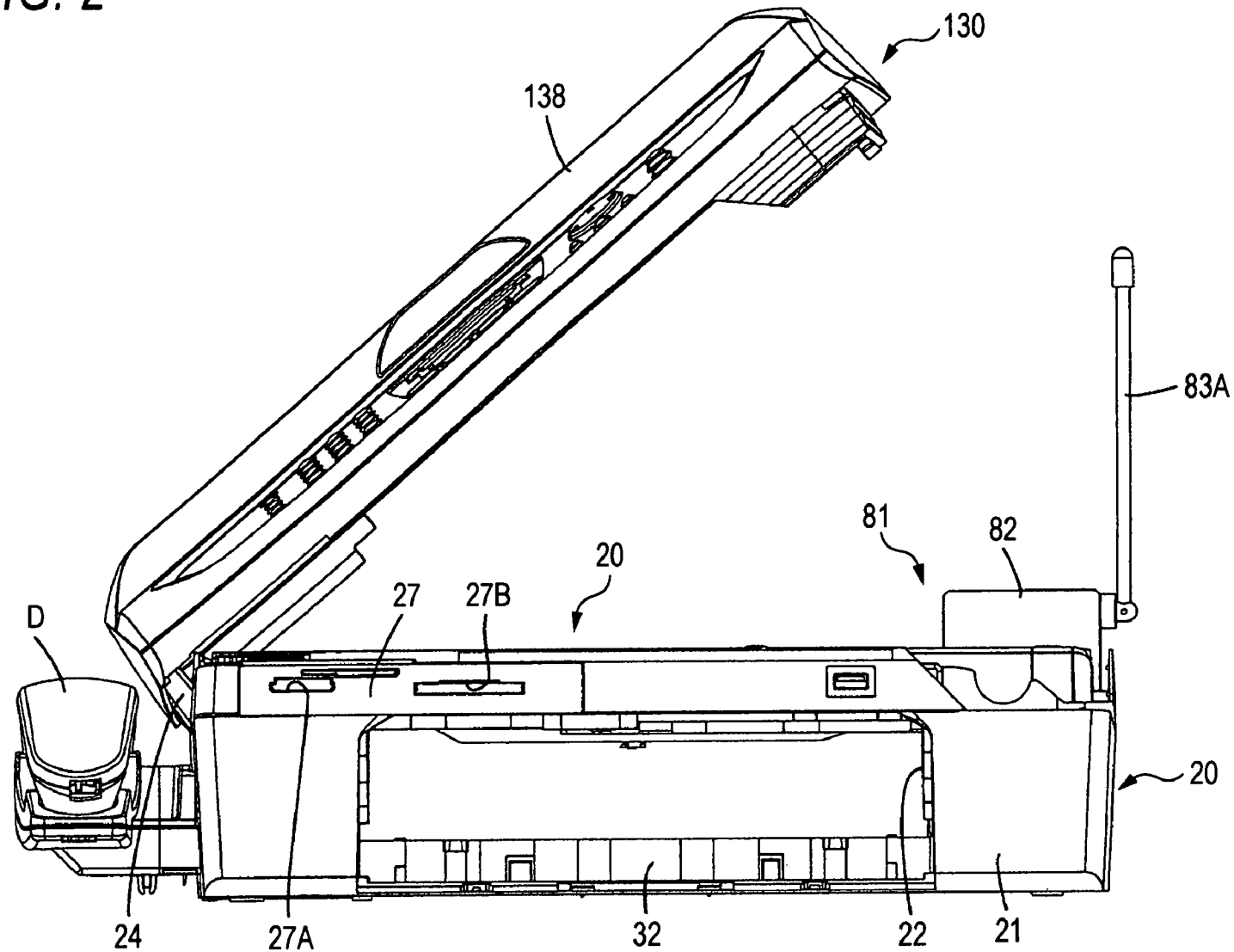
FIG. 2 is a front view showing a state where a scanner device is opened.

The scanner device 130 is connected to the case body 21 through a hinge 24 which is provided at the side edge of the upper surface of the case body 21 (the left side edge of FIG. 2) and it is designed so as to be opened sideways around the hinge 24 as shown in FIG. 2 from the state that it is stacked on the upper portion of the case body 21 as shown in FIG. 1. A holding member (not shown) is provided to the case body 21. The holding member is engagedly fitted to the bottom surface of the scanner device 130 so as to keep the scanner device 130 to a sideways-opened state.

A receiver body (hereinafter referred to as "master phone") D is provided at the outer surface side of a side wall (left side in FIG. 2) of the case body 21 to enable telephone call. By disposing the master phone D at the left side of the case body 21 as described above, for example when a jammed recording sheet is removed or an ink cartridge is exchanged, it is possible for a user to carry out the removing or exchanging work with his/her right hand while holding the master phone D by his/her left hand and receiving an instruction on the removing or exchanging method. In this embodiment, the master phone D is mounted at the highest possible position under the condition that it does not interfere with the scanner device 130 when the scanner device 130 is set to the sideways-opened state, that is, a gap is kept between the master phone D and the scanner device 130 even in consideration of dispersion of products, etc. The master phone D is disposed at the highest possible position of the upper side of the base body 21 in consideration of usability when the master phone D is used.

A communication unit 81 is mounted in a vertical position at the right side edge portion of the rear portion of the case body 21 as shown in FIG. 1. The communication unit 81 has a casing 82 formed of synthetic resin, and the communication board 83 is accommodated in the casing 82. This communication board 83 is used to wirelessly connect the communication unit 81 to another transceiver (hereinafter referred to as a slave phone) and has an antenna 83A for transmission/reception.

As described above, the composite machine 10 is provided with the directly connected master phone D and the cordless slave phone, and both the receivers (master phone, slave phone) are selectively usable in accordance with an application. Furthermore, the communications can be carried out between both the receivers. As described in detail later, a main board (corresponding to a circuit board of the embodiment of the present invention) 61 for electrically controlling the driving of each device is provided at a corner portion 21A out of the corner portions of the case body 21, the corner portion 21A being located at the opposite corner to a corner portion 21B at which the communication board 83 is disposed. As described above, the main board 61 and the communication board 83 are disposed so as to be away from each other so that noise is prevented from being applied to the main board 61.

Next, the print device 20 will be described.

The printer device 20 of this embodiment is an ink jet type, and mainly comprises a recording unit (corresponding to an image recording unit of the embodiment of the present invention) 41 for recording an image on a recording sheet, a supply unit 31 for supplying a recording sheet (corresponding to a recording medium of the embodiment of the present invention) to the recording unit 41 and a main board 61.

First, the supply unit 31 will be described. As shown in FIG. 1, a tray accommodating unit 22 penetrating in the front-and-rear direction is provided at the center lower portion of the case body. A supply tray 32 is engagedly fitted in the tray accommodating unit 22 so as to be detachable from the front side. The supply tray 32 is formed of synthetic resin and designed like a plate. An arch-shaped guide piece 33 is provided from both the right and left edge portions so as to cover the upper side of the recording sheet set on the tray. The guide piece 33 has a function of positioning the recording sheet in the right-and-left direction and a function as a discharge tray (described later).

Under the mount state, the supply tray 32 is wholly accommodated in the tray accommodating unit 22, and the tip position of the supply tray 32 is substantially coincident with the front end position of the tray accommodating unit 22. Furthermore, under this state, a gap is provided between the upper surface portion of the guide piece 33 and the ceiling wall 22A of the tray accommodating unit 22 (see FIG. 5).

Figure 5:
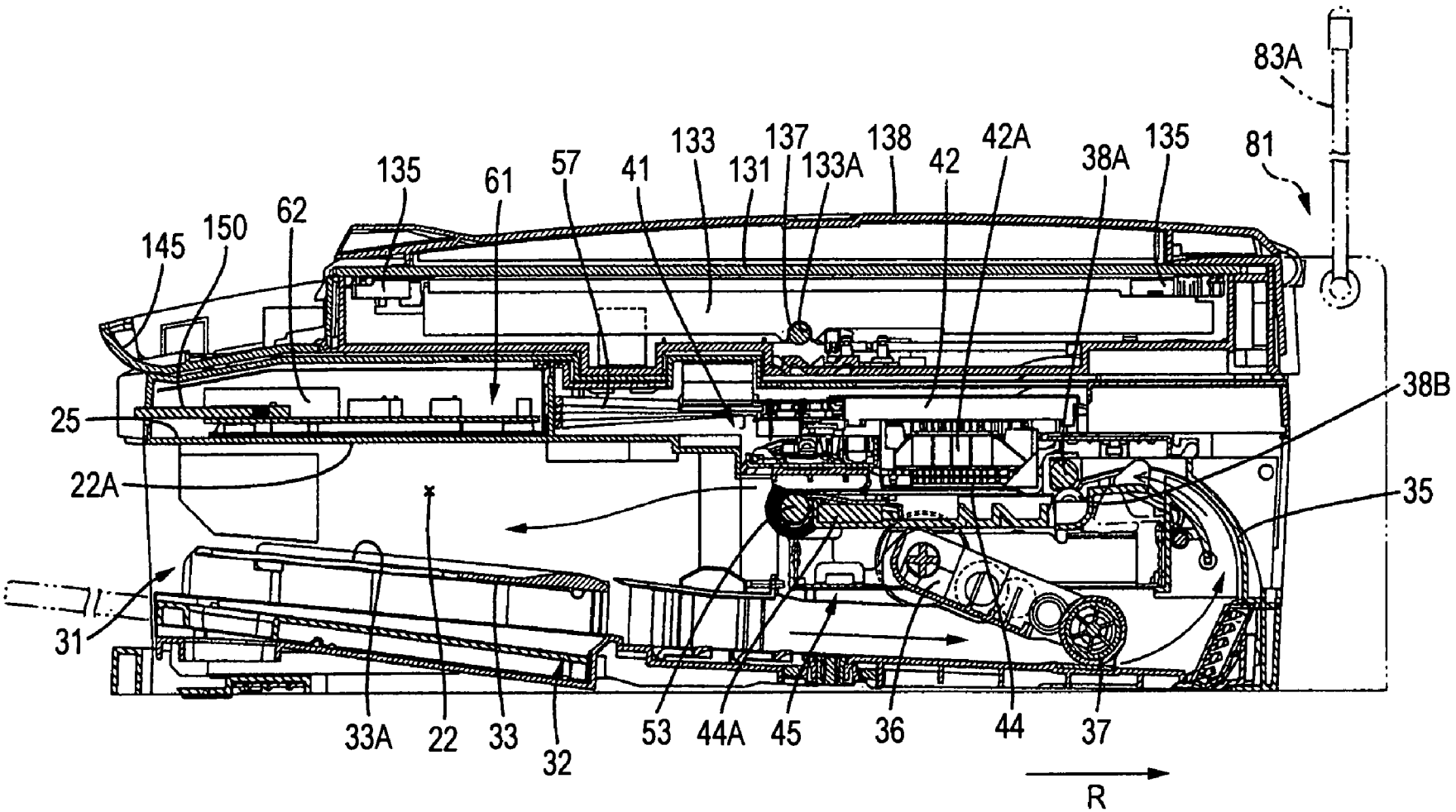
FIG. 5 is a vertically cross-sectional view of the composite machine.

As shown in FIG. 5, an arcuate plate 35 for U-turn is mounted at the innermost surface side of the tray accommodating unit 22. A supply roller 37 is pivotably mounted on an engine frame 45 through an arm 36 so as to droop down. The supply roller 37 is connected to a motor serving as a driving motor through a link shaft (not shown), and abuts against the upper surface of the recording sheet mounted on the supply tray 32.

Therefore, when the supply roller 37 is driven through the motor, recording sheets on the supply tray 32 are fed out from the front side of the printer device 20 to the inner back side (R direction of FIG. 5) one by one. Each recording sheet thus fed out is reversed from the lower side to the upper side through the U-turn plate 28 by 180 degrees. Thereafter, the recording sheet thus reversed is fed out to the front side, that is, to the recording unit 41 by a resist roller 38A and a driven roller 38B rotated in connection with the rotation of the resist roller 38, the resist roller 38A and the driven roller 38B being disposed at the front side of the U-turn plate 35.

The recording unit 41 mainly comprises a carriage 42 having a recording head 42A, a platen 44, a timing belt 49 connected to the motor and the engine frame 45 for supporting the above elements. The engine frame 45 is disposed at the rear side of the case body 21 and at the upper side of the supply tray 32. The engine frame 45 is formed of metal, and it comprises a box-shaped main body portion 45A and a pair of guide plates 46, 47 which are mounted on the upper side of the main body portion 45A so as t extend in the right-and-left direction of the case body 21. The arm 36 of the supply roller 37 is freely rotatably secured to the main body portion 45A through a shaft, and the platen 44 and a waste liquid foam 44A are secured to the main body portion 45A.

The guide plates 46, 47 are formed of metal and aligned with each other in the front-and-rear direction. The carriage 42 is mounted so as to straddle over both the guide plates 46, 47 in the front-and-rear direction. Under this mount state, respective sliding projections (not shown) formed on the carriage 42 abut against the rear portion of the guide plate 46 at the front side and the front portion of the guide plate 47 at the rear side (hereinafter referred to as sliding portions 46A, 47A).

When the motor, furthermore the timing belt 49 is driven, the respective sliding projections slide along the respective sliding portions 46A, 47A, and also the carriage 42 reciprocates along the right-and-left direction of the printer device 20. Accordingly, an image is recorded on a recording sheet fed through the supply unit 31 to the recording unit 41 by the recording head 42A.

Figure 6A:
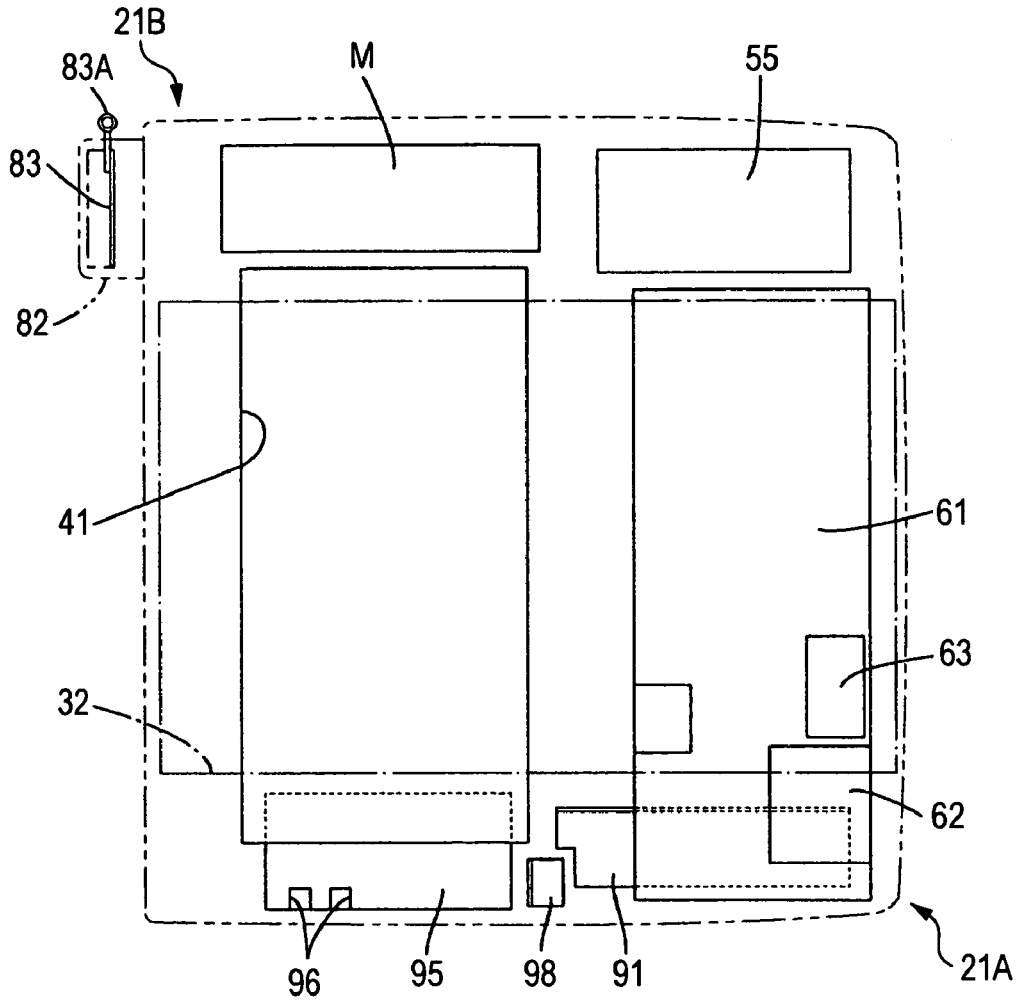
FIG. 6 is a diagram showing the arrangement of respective boards.
Figure 6B:
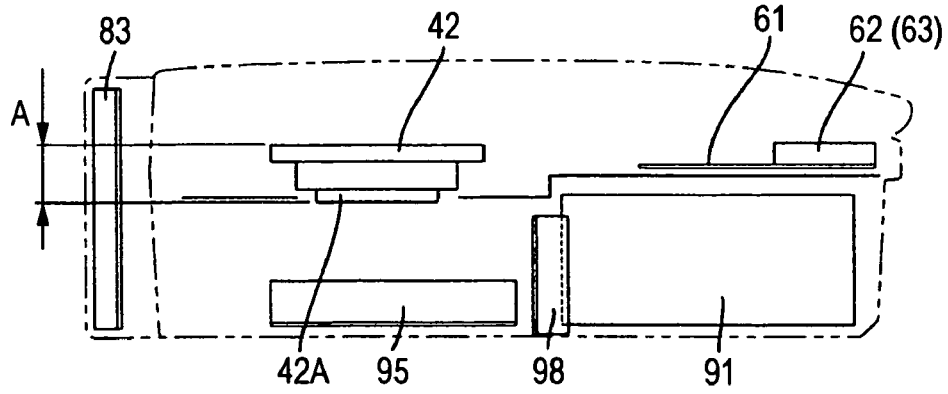

As shown in FIG. 5, a discharge roller 53 is provided at the front side of the engine frame 45. The discharge roller 53 is connected to the motor through interlocking means (not shown), and discharges a recording sheet having an image formed thereon onto the guidepiece 33. As described above, the portion for supplying a recording sheet and the portion to which the recording sheet is discharged are stacked in the vertical direction. In addition, no dedicated discharge tray is provided, and the guide piece 33 serves as the function of the discharge tray. Accordingly, the height of the overall device can be reduced. The guide piece 33 and the discharge roller 53 correspond to a discharge portion of the embodiment the present invention, As shown in FIG. 6, a maintenance mechanism for cleaning the recording head and a cartridge holder 55 are arranged in the front-and-rear direction at the right side (the upper side in FIG. 6) of the supply tray 32. The cartridge holder 55 is designed in a box-shape opened upwardly, and ink cartridges 56 of four colors are accommodated in the cartridge holder 55. Each ink cartridge 56 and the recording head 42A are connected to each other by a liquid feeding tube 57, and when ink is jetted from the recording ink head 42A, the ink is supplied from the ink cartridge 56 to the recording head 42A. As described above, the recording head 42A and the ink cartridge 56 are disposed so as to be away from each other, whereby the height of the overall device is reduced.

A power supply unit 91 and a network board 95 are disposed at the left side (the lower side of FIG. 69 of the supply tray 32. A flat seat surface portion 25 (see FIG. 5) is provided at the front side of the case body 21 and above the supply tray 32, and the main board 61 is disposed on the flat seat surface portion 25.

The main board 61 is designed in a substantially rectangular shape so as to extend along the driving direction of the recording head 42A, and also covered by a shield case 70 of iron described later. Under the mount state, the main board 61 is located substantially within a height range (within the dimension A shown in FIG. 6) where the carriage 42 and the recording head 42A configuring the recording unit 41 are provided. If the main board 61 and the recording unit 41 are arranged within the same height range as described above, the height of the device can be reduced as compared with the case where they are stacked in the vertical direction.

Figure 7:
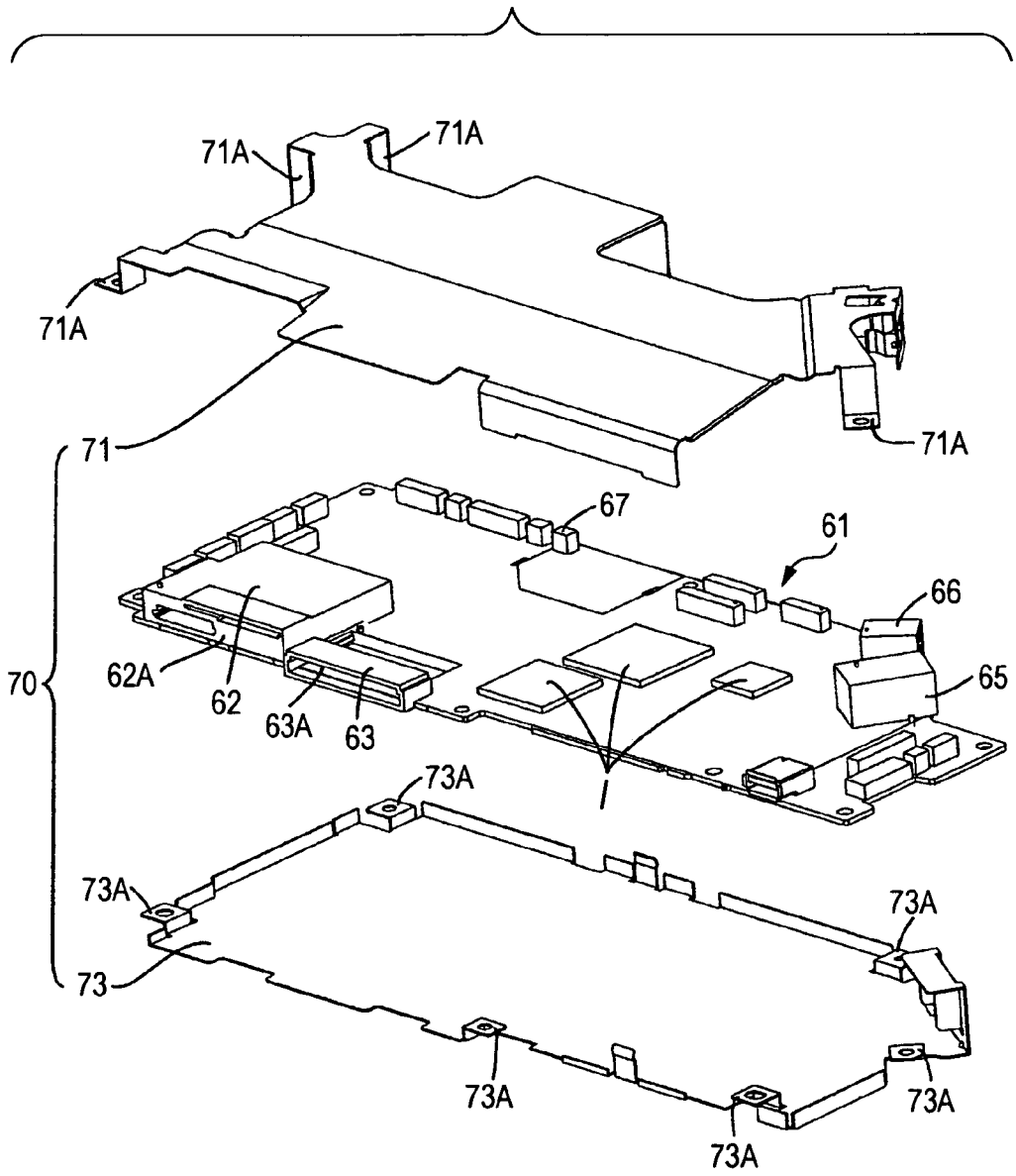
FIG. 7 is an exploded perspective view showing a shield case.

Electrical parts I and various kinds of connectors are mounted on the main board 61. Describing more specifically, two connectors provided at the front side of FIG. 7 are connectors 62, 63 for connecting media cards. These connectors 62, 63 are mounted on the main board 61 so that the fitting faces 62A, 63A thereof in which various kinds of media cards (corresponding to the recording media of the embodiment of the present invention) are engagedly fitted face the front side.

Furthermore, a front face cover 27 is mounted on the front surface of the case body 21. Insertion ports 27A and 27B are formed in the front face cover 27 so as to intercommunicate with the fitting faces 62A, 63A of the connectors 62, 63. When a media card 150 is inserted from the insertion port 27A, 27B, the media card 150 is engagedly fitted in the connector 62, 63 to be electrically connected to the main board 61.

As described above, the connectors 62, 63 are directly secured to the main board 61, and thus no harness is needed. Therefore, the cost can be reduced, the assembling performance can be enhanced, and the quality can be stabilized. Furthermore, the insertion ports 27A, 27B are opened to the front surface of the front surface cover 27, so that the media cards 150 can be simply set. The connectors 62, 63 correspond to the connector to which the recording medium of the embodiment of the present invention can be connected.

A USB connector 66 for connection of external equipment such as a personal computer or the like and a LAN connector 65 for connection of LAN are juxtaposed at the right side portion of the back aide of the main board 61, and also a connector 67 for connection of a network board is secured at a position at the back side of the board so as to be slightly displaced to the left side portion. The detailed description is omitted from the following description, however, plural connectors are provided on the board along the outer edge of the board in addition to the above connectors.

As shown in FIG. 7, the shield case 70 comprises an upper case 71 surrounding the upper side of the main board 71 and a lower case 73 surrounding the lower side of the main board 61. The lower case 73 is designed in a rectangular shape which substantially irritates the shape of the main board 61, and the rear portion of the outer periphery and right portion of the upper case 71 are greatly cut out inwardly. The cut-out portion serves as a clearance portion from/into which the connector is exposed to be pulled out/inserted under the mount state.

As described above, substantially the overall main board 61 excluding the connector portion is covered by both the cases 71, 73. Plural projecting edges 71A, 73A are formed at the outer edge portions of both the cases 71, 73 so as to project laterally. These projecting edges serve as fixing edges for fixing both the cases by screws.

The shield case 70, the main board 61 and the parts mounted on the main board 61 correspond to the control unit of the embodiment of the present invention, and the connectors 65, 66 correspond to the reception side connectors of the embodiment of the present invention.

As described above, the main board 61 is covered by the shield case 70 to take a countermeasure to noise caused by electromagnetic waves such as electric waves, etc. The power supply unit 91 and the communication board 83 maybe considered as a main trouble source of noises. The communication board 83 is equipped with the antenna 83A, and reception/transmission of electric waves is carried out from/to the antenna 83A, so that the antenna 83A particularly serves as a strong noise source. Therefore, when both the boards 61, 83 are arranged to be proximate to each other, there is a risk that the main board 61 is affected by noises and thus it does not function normally. However, according to this embodiment, the main board 61 is disposed at the left corner portion 21A of the front side of the case body, and the communication board 83 is disposed at the counter-corner to the main board 61, that is, at the right corner portion 21B of the rear side of the case body. Accordingly, the main board 61 is located to be away from the communication board 83, so that the main board 61 is hardly affected by the communication board 83. Therefore, this embodiment is effective as a noise countermeasure and the communication function can be normally performed.

Figure 3:
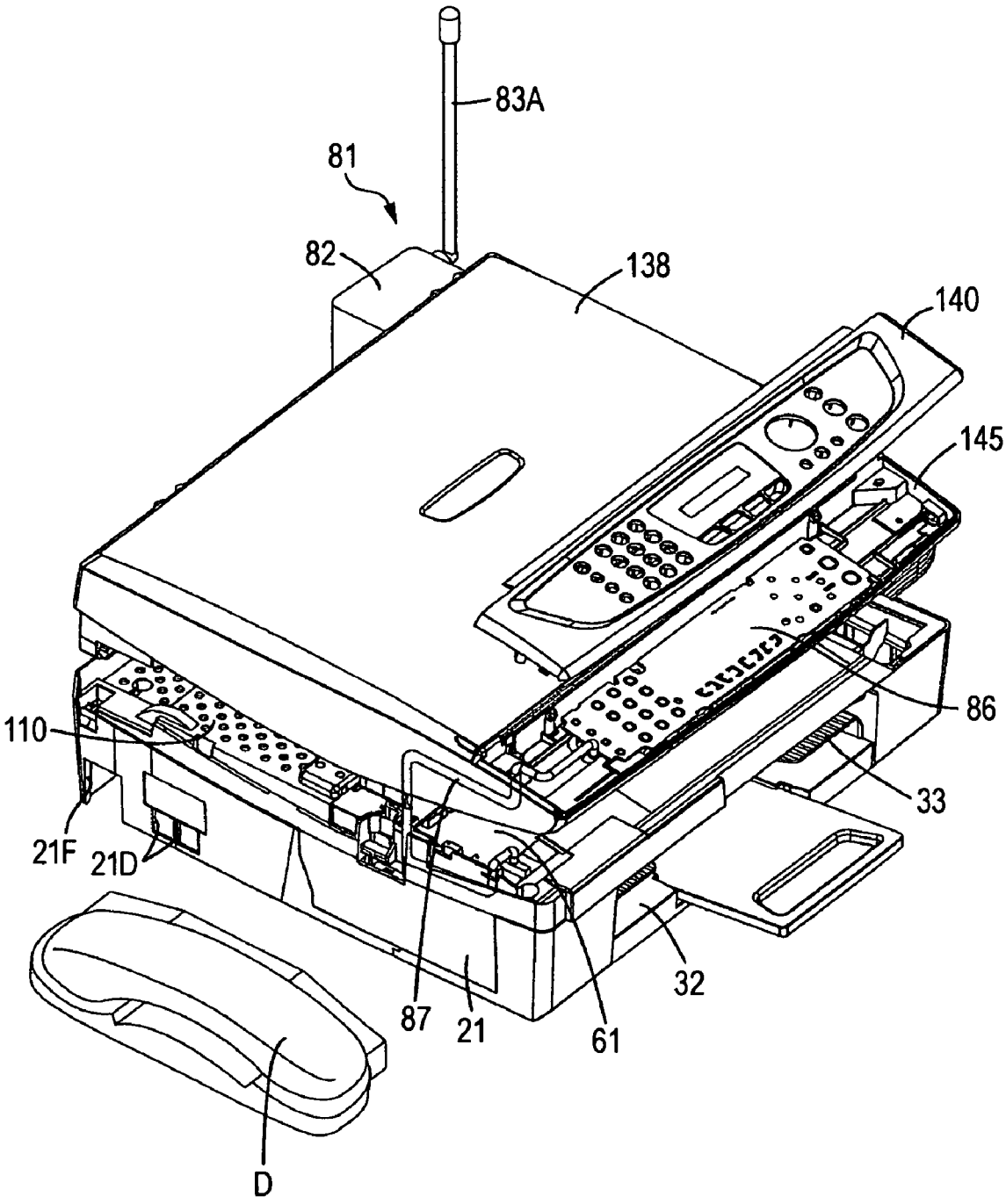
FIG. 3 is a perspective view showing an accommodation position of an operation board.
Figure 4:
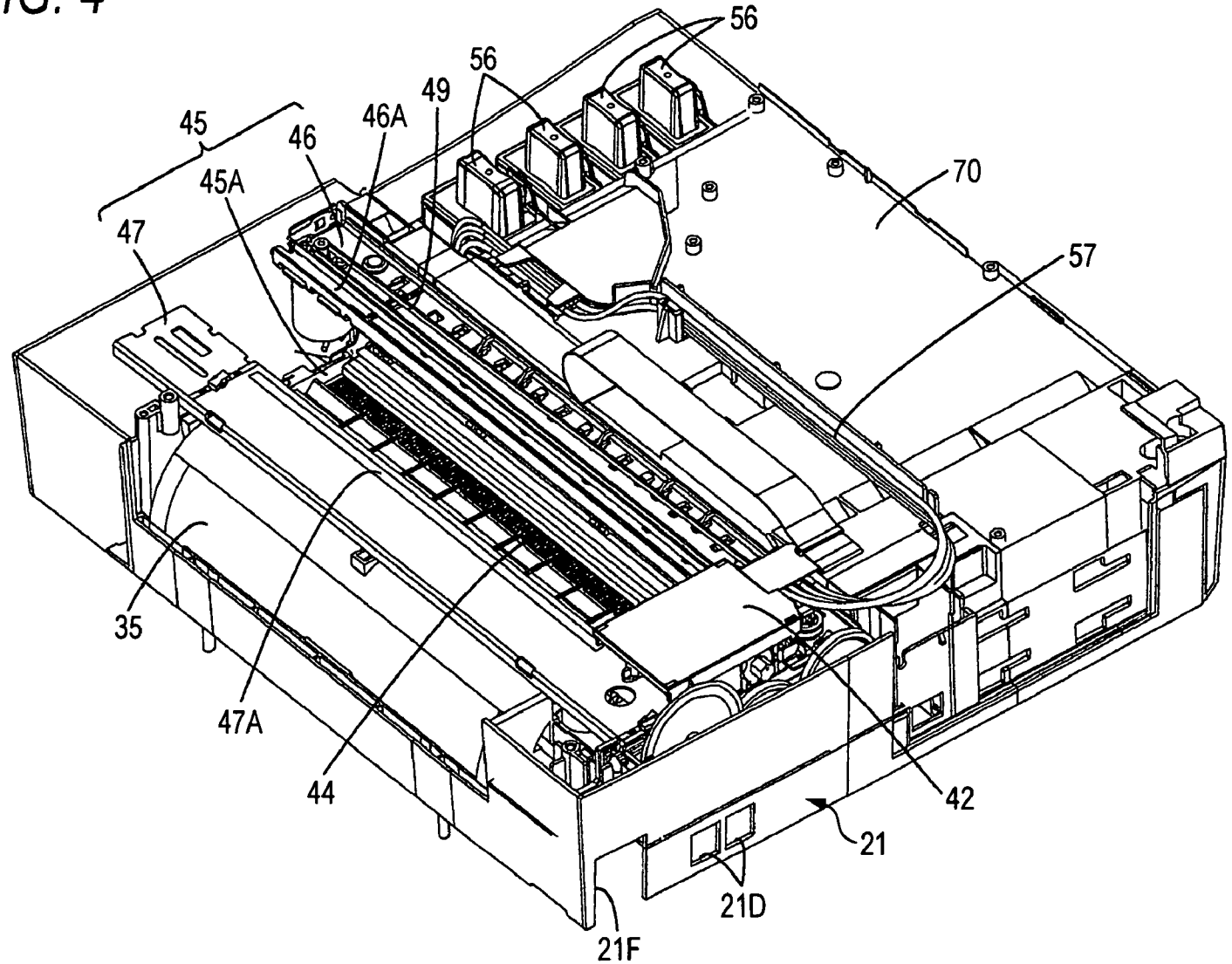
FIG. 4 is a perspective view taken from the rear side of a printer device.

Furthermore, as shown in FIG. 3 a board accommodating unit 145 is provided at the front side of the scanner device 130, and an operation board 86 is accommodated in the board accommodating unit 145. The operation board 86 is located substantially just above the main board 61, and also electrically connected to the main board 61 by a cable 87. The cable 87 uses the hinge 24 of the scanner device 130 as a wiring path. With the above construction, excessive tensile force suppressed from acting on the cable 87 in connection with the opening/closing operation of the overall scanner device 130. Furthermore, the main board 61 is disposed to be adjacent to the hinge 24, and thus a short wiring path is sufficient for the cable 87.

next, the network board 95 and the power supply unit 91 will be described with reference to FIG. 8.

The power supply unit 91 is designed in a longitudinally elongated block shape, and contains a power supply board 92 having a power supply circuit mounted therein. It generates DC 5V used as power source for a memory, etc. and DC 30V for operating actuators such as a motor, etc. The power supply board 92 and the main board 61 and the power supply board 92 and the motor are connected to each other by electric wires (not shown), and voltages generated in the power supply board 92 are applied to the main board 61 and the motor, respectively.

The network board 95 is a board for carrying out a fixed-line communication through a telephone line, and it has two modular connectors 96, that is, a modular connector for telephone line connection and a modular connector for an external receiver in this embodiment. Accordingly, data communications with other facsimile machines and telephone calls based on the external receiver can be performed.

Figure 8:
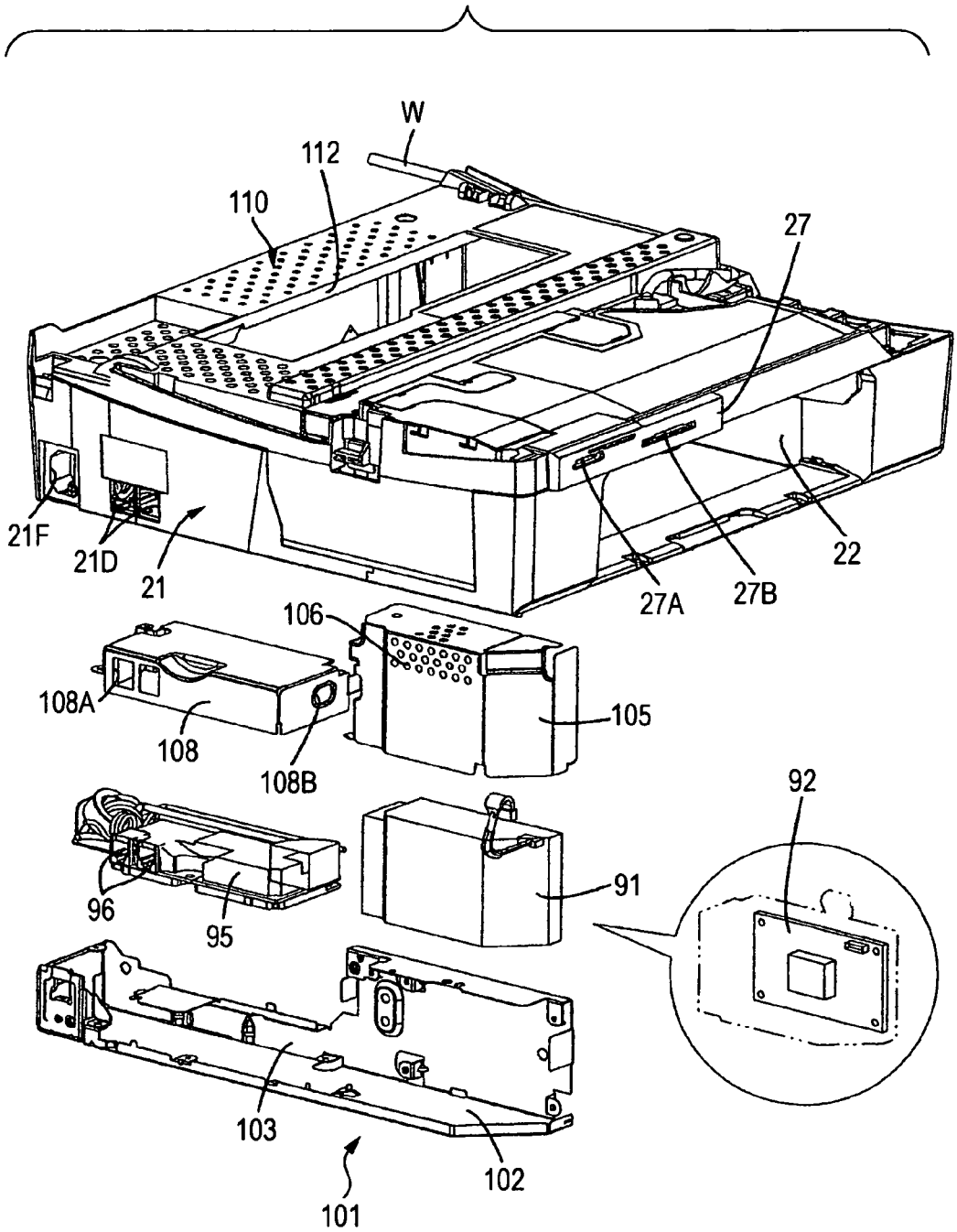
FIG. 8 is a perspective view before a power supply unit is mounted in the printer device.
Figure 9:
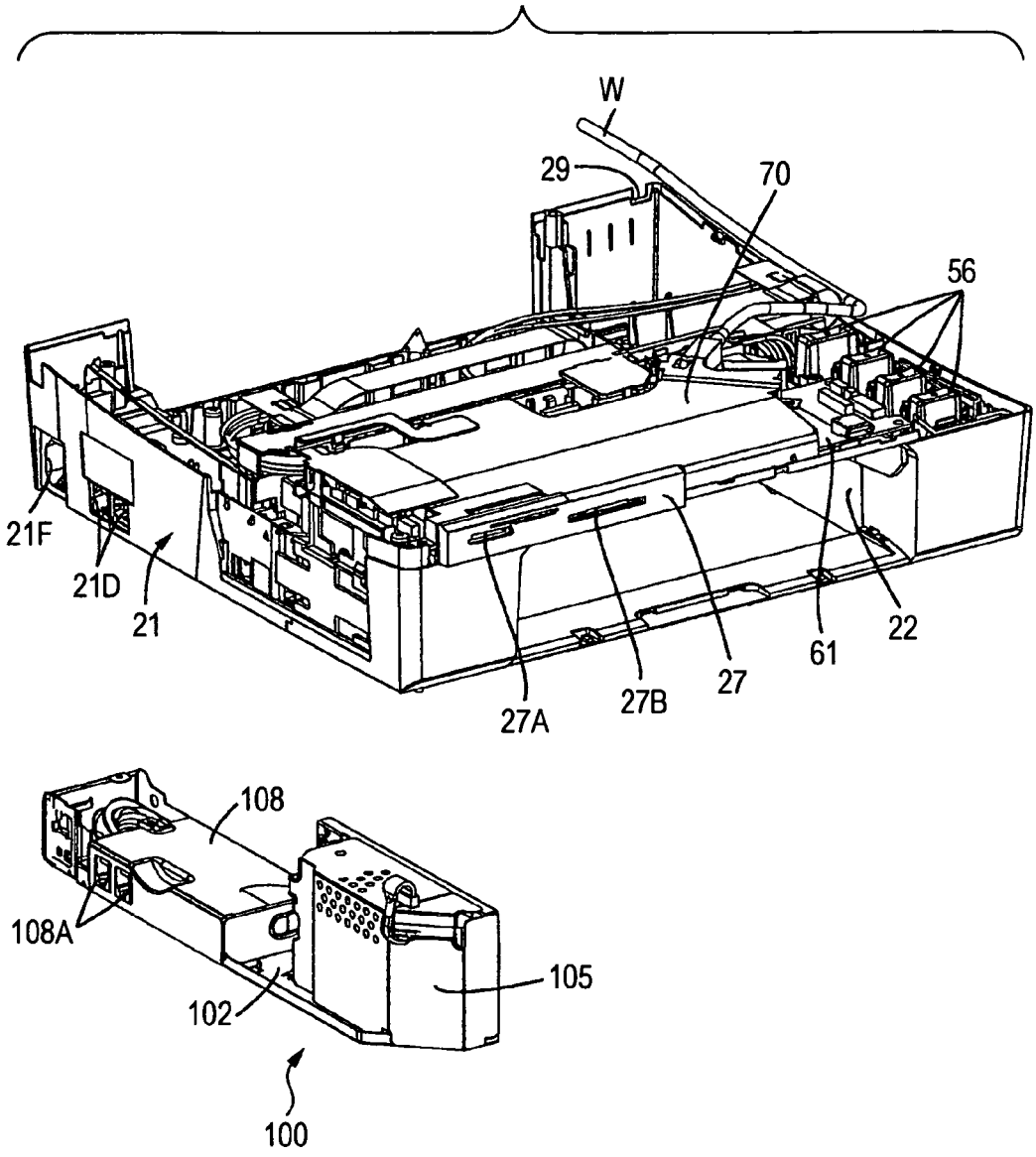
FIG. 9 is an exploded perspective view showing the power supply unit.

As shown in FIGS. 8 and 9, the power supply unit 91 and the network board 95 are mounted on a metal fixing plate (corresponding to the fixing member of the embodiment of the present invention) 101 to be assembled as a unit (hereinafter referred to as power supply unit 100). The fixing plate 101 has a plate-shaped base portion 102 extending in the front-and-rear direction of the case body 21, and it is provided with a side wall 103 in the area from the rear end side to the side edge portion.

The power supply unit 91 is mounted at the front side of the fixing plate 101, and the network board 95 is mounted at the rear side of the fixing plate 101. Furthermore, the power supply unit 91 and the network board 95 are provided with dedicated protection covers (corresponding to the coating member of the embodiment of the present invention) 105 and 108, respectively.

The protection covers 105 and 108 are formed of metal, and designed in a substantially box-shape so as to surround the exposed portions of the power supply unit 91 and the network board 95. Under the mount state, the protection covers 105 and 108 surround substantially the whole bodies of the power supply unit 91 and network board 95 together with the fixing plate 101. Clearance holes 108A are formed in the protection cover 108 for the network board so as to face the modular connectors 96, and an oval opening 108B is formed in a side surface of the protection cover 108 which faces the power supply unit 91. The electric wire for the connection of the main board (not shown) is drawn out from the opening 108B. The protection cover 105 for the power supply unit 91 is provided with plural punch holes 106, and these holes are used for ventilation so that heat occurring in the power supply unit 91 dwells inside.

As described above, both the boards 91, 95 are surrounded by the protection covers 105, 108 to thereby protect the boards 91, 95. In addition, even if these boards 91, 95 ignite due to electric leak or the like, the protection covers 105 and 108 function to suppress (prevent) spreading of ignition. Furthermore, not shown in detail, such a protection cover is provided to the connector located at the left-handed side of the back side of the main board 61, that is, the connector 67 for the connection of the network board.

An opening (not shown) having substantially the same size as the power supply unit 100 is formed in the bottom surface of the case body 21 along the front-and-rear direction of the case body 21, and the power supply unit 100 is mounted from the opening into the case body 21. As described above, the power supply unit 100 is mounted into the case body 21 from the bottom surface side of the case body 21, whereby only the power supply unit 100 can be detached without detaching the other devices, etc. when a maintenance work is carried out. Furthermore, a specification development (100V or 200V) can be easily performed.

Clearance holes 21D are formed in the side wall of the case body 21 so as to face the modular connectors 96 of the network board 95, and a cord draw-out port 21F for drawing out a power supply cord is opened at the rear side of the clearance holes 21D. Under the mount state, the clearance holes 21D are located in front of the modular connectors 96, and modular jacks are inserted from the clearance holes 21D.

Furthermore, under the mount state, the power supply unit 91 is located substantially beneath the main board 61. This arrangement can shorten the overall length of the electrical wire through which the main board 61 and the power supply board 92 are connected to each other.

Still furthermore, as shown in FIG. 6, a sensor board 98 for detecting use/non-use of the master phone D is provided between the power supply unit 91 and the network board 95.

Figure 10:
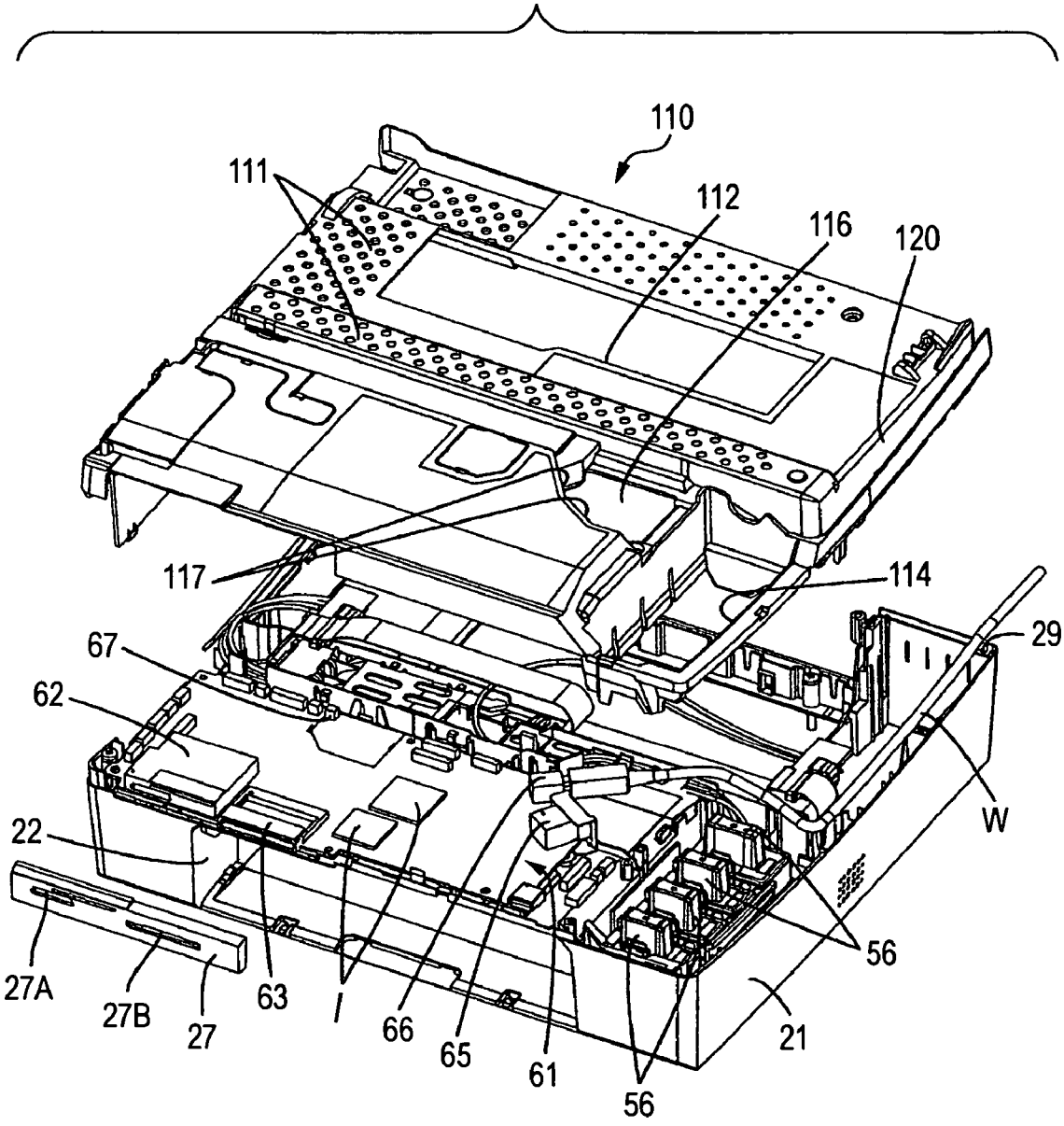
FIG. 10 is a perspective view showing a main-body cover and the printer device.

Reference Numeral 110 in FIG. 10 represents a main-body cover for covering the overall upper surface of the printer device 20. The main-body cover 110 is formed of synthetic resin, and it is designed to be so large in size that the opened upper surface of the case body 21 can be substantially covered by the main-body cover 110. Plural ventilation holes 111 are provided at the rear side of the main-body cover 110, and an opening 112 is formed along the width direction of the cover. The upper end side of the carriage 42 is exposed from the opening 112. A cartridge port 114 is formed at the right portion of the front side of the main-body cover 110 so as to face the ink cartridges 56 such that the four cartridges 56 mounted in the holder 55 are insertable through the cartridge port 114 in a lump.

Furthermore, a bearing surface 16 for cable wiring is provided at a side (upper side in FIG. 10) of the cartridge port 114. The bearing surface 116 is formed so that a step is formed between the bearing surface 116 and the other surface of the main-body cover 110. The portion of the step portion which faces the connectors 65, 66 of the main board 61 is opened, and it serves as a connector insertion port 117.

A cable wiring groove 120 is formed from the back side of the bottom surface 116 so as to extend along the right wall surface of the main-body cover 110. The cable wiring groove 120 is designed to have a shape like a trough, and reaches the rear end of the main-body cover 110. Under the mount state, the connector insert port 117 of the bottom surface 116 intercommunicates with each of the connectors 65, 66 of the main board 61, and the rear end portion of the cable wiring groove 120 is just coincident with the cable outlet 28 provided at the back wall of the case body 21.

Figure 11:
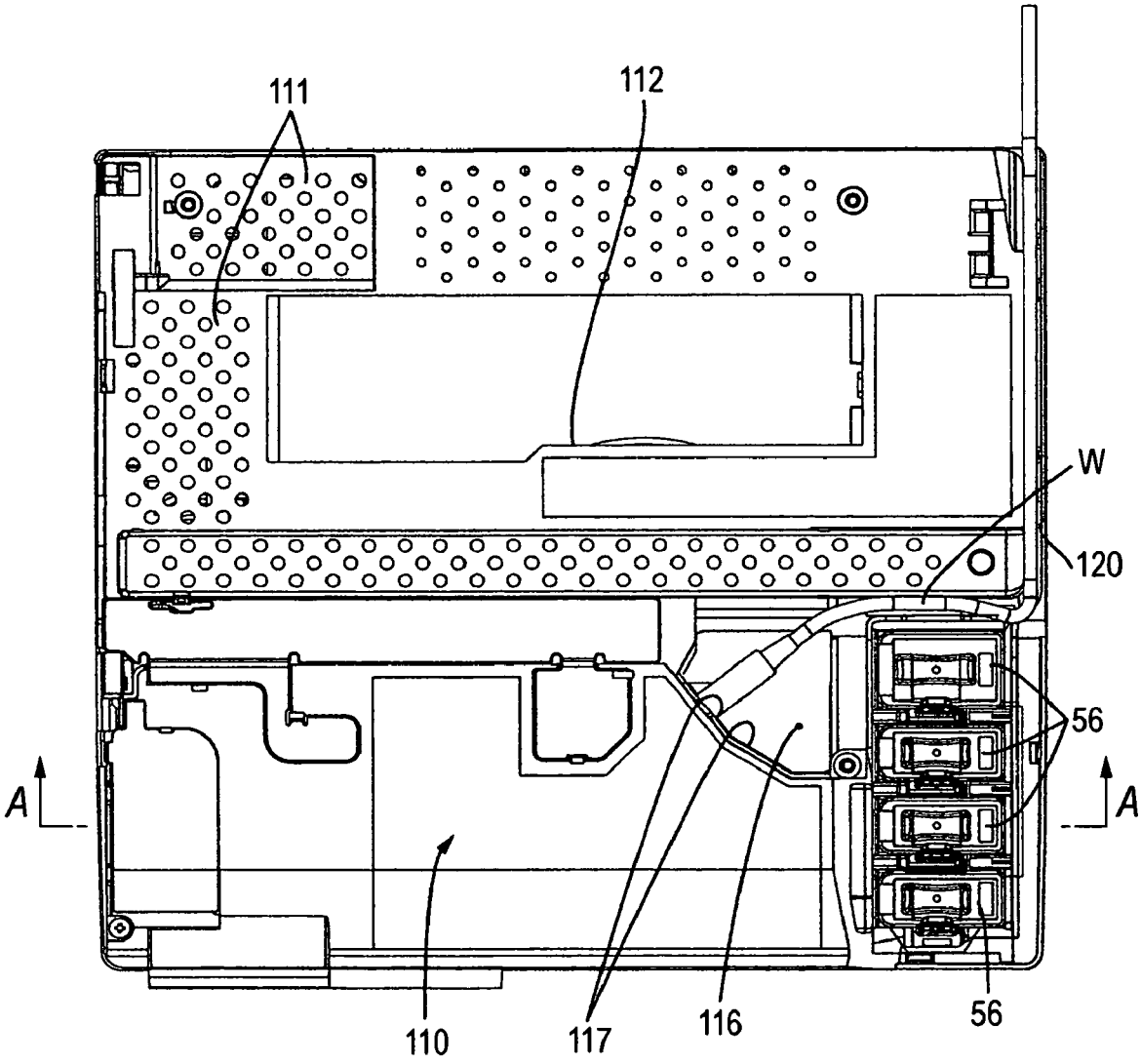
FIG. 11 is a plan view showing the printer device.
Figure 12:
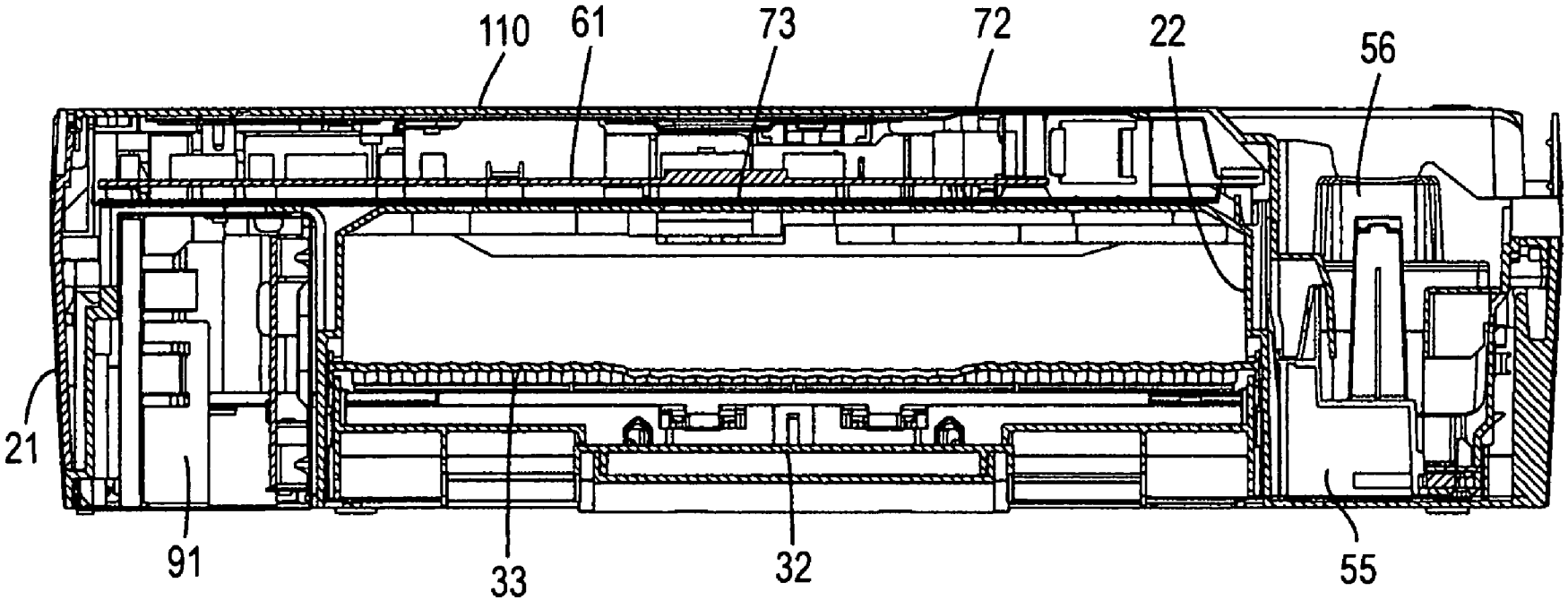
FIG. 12 is a cross-sectional view taken along A-A line of FIG. 11.

Therefore, the wiring of the cable W can be performed while the main-body cover 110 is mounted on the case body 21 as shown in FIG. 11. The cable W thus wired is accommodated in the cable wiring groove 120, and thus there can be beforehand prevented occurrence of such a situation that when the scanner device 130 is opened/closed, the cable W is pinched and thus damaged by the case body 21 and the scanner device 130. Furthermore, under the mount state, each ink cartridge 56 is exposed from the cartridge port 114, and thus the ink cartridge 56 can be exchanged while the main-body cover 110 is mounted.

Next, the scanner device 130 for reading an image of an original while the upper cover 138 is opened/closed and the original is placed will be briefly described. The scanner device 130 mainly comprises an original table glass 131 a read-out unit 133 and a slider 135. The read-out unit 133 having a reading sensor such as a contact image sensor or the like is disposed at the lower surface side of the original table glass 131 on which an original is put. A pair of front and rear sliders 135 are mounted between the original table glass 13 and the read-out unit 133, whereby the read-out unit 133 is freely slidable in the width direction of the composite machine 10, that is, in the right-and-left direction of FIG. 1. Furthermore, an engaging hole 133A opened downwardly is provided at the lower end portion of the center of the read-out unit 133, and a guide shaft 137 extending along the width direction of the composite machine 10 is engagedly fitted in the engaging hole 133A. The guide shaft 137 is used to guide the sliding operation of the read-out unit 133.

According to this embodiment, the main board 61 is located above the supply tray 32 and substantially within the height range of the recording unit 41, and further it is disposed in alignment with the recording unit 41. When the main board 61 and the recording unit 41 are arranged in alignment with each other as described above, the height of the device can be reduced as compared with the case where they are arranged to be stacked in the vertical direction. In addition, the portion from which a recording sheet is supplied and the portion to which the recording sheet is discharged are stacked in the vertical direction, so that the height of the device can be further reduced. Furthermore, under the mount state, substantially the overall supply tray 32 is accommodated in the tray accommodating portion 22, and thus there is no part of the supply tray 32 which protrudes to the outside of the device. Accordingly, the device can be also miniaturized in the depth direction.

Furthermore, if the miniaturization of the device is promoted, various electric parts, etc. are arranged in close vicinity to one another in the case body 21.

If the main board 61 and the communication board 83 are arranged in vicinity to each other, the main board 61 is liable to suffer noises. However, the main board 61 is disposed at the left corner of the front side of the case body 21, and the communication board 83 is located at the opposing site to the main board 61, that is, at the right corner of the rear side of the case body 21, so that both the boards 61 and 83 are spaced from each other. Accordingly, this arrangement is effective to the noise countermeasure.

Other Embodiments

The present invention is not limited to the above embodiment described with reference to the drawings. For example, the following embodiments are contained in the technical field of the present invention, and various modifications described below may be applied without departing from the subject matter of the present invention.

(1) According to this embodiment, both the upper and lower surfaces of the main board 61 are surrounded by the shield case 70. However, only one of the surfaces may be surrounded by the shield case 70.

(2) According to this embodiment, the protection covers 105, 108 covering the power supply unit 100 are formed of metal, however, they may be formed of flame retardant synthetic resin.

(3) According to this embodiment, the guide piece 33 of the supply tray 32 also acts as the discharge tray. However, a dedicated discharge tray may be provided.

(4) According to this embodiment, the recording-sheet discharged portion and the supply tray 32 are arranged to be stacked in the vertical direction. However, nothing is required except that the main board 61 is disposed above the supply tray 32 or the recording sheet discharged portion, and for example, the supply tray 32 and the recording-sheet discharged portion may be arranged to be positionally displaced or separated from each other.

What is claimed is:

1. An image recording apparatus comprising:

an image recording unit that records an image on a recording medium by ejecting ink;

a container mounting portion to which an ink container is mounted, the ink container being configured to store ink and connectable to the image recording unit via a tube;

a supply unit that is disposed at a front side of the image recording apparatus and that supplies a recording medium to the image recording unit;

a discharging unit that is disposed at the front side of the image recording apparatus and that discharges the recording medium having the image recorded thereon to a discharge space which is open at a front side and surrounded at at least a top side, a rear side, a right side and a left side by the image recording apparatus;

a conveying portion that conveys the recording medium from the supply unit to the discharge unit;

an image reading unit that reads an image of a document placed in the image reading unit;

a control unit having a circuit board that controls a driving of the image recording unit, wherein the control unit is in alignment with the image recording unit within a height of the located image recording unit;

wherein the control unit is sandwiched between the image reading unit and the discharge space and is disposed not to overlap with the conveying portion in any of plan view, front view, and side views; and wherein the image recording unit reciprocates in a space between the image reading unit and the conveying portion.

2. The image recording apparatus according to claim 1, wherein the supply unit and the discharge unit are disposed to be stacked in an up-and-down direction of the image recording apparatus.

3. The image recording apparatus according to claim 1, wherein the image recording unit further includes a recording head which is reciprocated in a direction intersecting to a feeding direction of the recording medium, and wherein the control unit is designed in a laterally-elongated and substantially rectangular shape so as to extend along the reciprocating direction of the recording head.

4. The image recording apparatus according to claim 1, wherein a power supply unit is disposed at a lower side of the control unit so as to be located at at least one of a side of the discharge unit and a side of the supply unit.

5. The image recording apparatus according to claim 1, further comprising:

a network board that carries out a line-fixed communication through a communication line, wherein the network board is connected to the communication line through a wire so as to be adjacent to a power supply unit, and wherein the network board and the power supply unit are mounted on a fixing member to be assembled as a unit.

6. The image recording apparatus according to claim 5, wherein outer peripheries of the network board and the power supply unit are covered by a coating member.

7. The image recording apparatus according to claim 6, wherein one part of the coating member covers the outer periphery of the network board, and wherein the other part of the coating member covers the outer periphery of the power supply unit.

8. The image recording apparatus according to claim 1, wherein the control unit has a connector connectable to a recording medium.

9. The image recording apparatus according to claim 8, further comprising:

a housing accomodatable the image recording unit and the control unit therein, wherein the control unit is mounted in the housing so that the connector faces the front surface of the housing, and wherein the housing is provided with at least one; insertion port intercommunicating with the connector.

10. The image recording apparatus according to claim 9, further comprising:

a reception-side connector which is provided above the control unit and electrically connects to other electronic equipment, wherein the housing is provided with a cable wiring groove having one end side intercommunicating with the reception-side connector and the other side intercommunicating with a cable outlet opened to any side surface of the housing.

11. The image recording apparatus according to claim 1, wherein the control unit is configured by the circuit board, and wherein the circuit board is surrounded by a metal shield member.

12. The image recording apparatus according to claim 11, wherein the shield member is divisibly configured by a pair of shield cases for accommodating a circuit board between the confronting faces thereof.

13. The image recording apparatus according to claim 1, wherein an image reading unit readable image information of an original is mounted on an upper surface of the housing while one side edge portion of the upper surface of the housing serves as a hinge, wherein an operation unit having a circuit board for inputting an operation signal is appended to the image reading unit, wherein the control unit is disposed to be adjacent to a side wall of the housing at which the hinge is provided, and wherein the hinge portion serves as a wiring path of a cable for connecting the control unit and the operation unit to each other.

14. The image recording apparatus according to claim 1, wherein the control unit and the image recording unit is substantially disposed in a direction of a feeding direction of the recording medium.

15. The image recording apparatus according to claim 1, wherein the control unit is disposed at an upper side of both the supply unit and the discharge unit.

16. The image recording apparatus according to claim 1, wherein the control unit is disposed to overlap with a part of the supply unit and a part of the discharge unit in plan view.

17. The image recording apparatus according to claim 1, wherein the container mounting portion is disposed below the circuit board.

18. The image recording apparatus according to claim 1, wherein the container mounting portion is disposed in a horizontal direction of the conveying portion.

19. The image recording apparatus according to claim 1, wherein the recording medium is conveyed in the conveying portion in a conveying direction; and wherein the container mounting portion is disposed at an upstream side of the conveying portion in the conveying direction.

20. The image recording apparatus according to claim 1, wherein the recording medium is conveyed in the conveying portion in a conveying direction;

wherein the image recording unit comprises a recording head movable in a scanning direction perpendicular to the conveying direction; and wherein the container mounting portion is disposed outside the conveying portion in the scanning direction as viewed from a downstream side of the conveying direction.

21. The image recording apparatus according to claim 1, wherein the ink container mounted to the container mounting portion is disposed not to overlap with the circuit board in any of plan view, front view, and side views.

22. The image recording apparatus according to claim 1, wherein the ink container is removably mounted to the container mounting portion.

23. The image recording apparatus according to claim 1, wherein the container mounting portion is disposed not to overlap with the circuit board in any of plan view, front view and side views.

24. An image recording apparatus comprising:

an image recording unit that records an image on a recording medium by ejecting ink;

a supply unit that is disposed at a front side of the image recording apparatus and that supplies a recording medium to the image recording unit;

a discharging unit that is disposed at the front side of the image recording apparatus and that discharges the recording medium having the image recorded thereon to a discharge space which is open at a front side and surrounded at at least a top side, a rear side, a right side and a left side by the image recording apparatus;

a conveying portion that conveys the recording medium from the supply unit to the discharge unit;

an image reading unit that reads an image of a document placed in the image reading unit;

a control unit having a circuit board that controls a driving of the image recording unit, wherein the control unit is in alignment with the image recording unit within a height of the located image recording unit;

wherein the control unit is sandwiched between the image reading unit and the discharge space and is disposed not to overlap with the conveying portion in any of plan view, front view, and side views; and wherein the image recording unit reciprocates in a space between the image reading unit and the conveying portion.

* * * * *